US011011115B1

(12) United States Patent
Fu

(10) Patent No.: US 11,011,115 B1
(45) Date of Patent: May 18, 2021

(54) METHOD, EQUIPMENT, AND SYSTEM OF ELECTRICAL DETECTING AND ADJUSTING TFT

(71) Applicant: Shenzhen China Star Optoelectronics Semiconductor Display Technology Co., Ltd., Guangdong (CN)

(72) Inventor: Jianhang Fu, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/621,677

(22) PCT Filed: Nov. 14, 2019

(86) PCT No.: PCT/CN2019/118410
§ 371 (c)(1),
(2) Date: Dec. 11, 2019

(30) Foreign Application Priority Data

Oct. 25, 2019 (CN) ..... 201911024260.1

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2310/0294* (2013.01); *G09G 2320/0626* (2013.01)

(58) Field of Classification Search
CPC ..... G09G 2320/045; G09G 2320/0233; G09G 2320/029; G09G 2320/0295; G09G 2320/0626; G09G 2310/0294; G09G 2300/043; G09G 2330/01; G09G 3/006; G09G 3/3258; G09G 3/3291
See application file for complete search history.

(56) References Cited

U.S. PATENT DOCUMENTS

2010/0253659 A1* 10/2010 Sugimoto ..... G09G 3/3233 345/206
2011/0007102 A1* 1/2011 Ogura ..... G09G 3/3233 345/690
2011/0096053 A1* 4/2011 Yamazaki ..... G09G 3/344 345/211
2012/0081381 A1* 4/2012 Kobayashi ..... G09G 3/32 345/558
(Continued)

*Primary Examiner* — Dong Hui Liang

(57) ABSTRACT

A method, an equipment, and a system of electrical detecting and adjusting TFTs are provided. The method includes steps of: obtaining a gate-source voltage ratio of each sub-pixel of a display device; detecting an output voltage of each driving TFT in a predetermined sampling time to obtain a detecting voltage; obtaining a constant value K according an input voltage of each driving TFT and the detecting voltage in the predetermined sampling time; adjusting the constant value K of each compensating sub-pixel in sequence according to a gate-source voltage ratio of a standard sub-pixel, a constant value K of the standard sub-pixel, and a gate-source voltage ratio of the compensating sub-pixel to obtain a compensating factor; and adjusting a pixel voltage of each compensating sub-pixel according to its compensating factors to obtain an adjusted pixel voltage.

11 Claims, 7 Drawing Sheets

(56) References Cited

U.S. PATENT DOCUMENTS

| | | | | |
|---|---|---|---|---|
| 2013/0063413 | A1* | 3/2013 | Miyake | H01L 27/3262 345/212 |
| 2013/0162617 | A1* | 6/2013 | Yoon | G09G 3/3233 345/211 |
| 2015/0029171 | A1* | 1/2015 | Jo | G09G 3/3258 345/212 |
| 2015/0123953 | A1* | 5/2015 | Shim | G09G 3/3233 345/205 |
| 2018/0226006 | A1* | 8/2018 | Wang | G09G 3/006 |
| 2018/0322829 | A1* | 11/2018 | Xie | G09G 3/3233 |
| 2019/0156753 | A1* | 5/2019 | Yang | G09G 3/3233 |
| 2020/0126482 | A1* | 4/2020 | Yang | G09G 3/3275 |
| 2020/0312246 | A1* | 10/2020 | Xu | G09G 3/3291 |

* cited by examiner

METHOD, EQUIPMENT, AND SYSTEM OF ELECTRICAL DETECTING AND ADJUSTING TFT

FIELD

The present disclosure relates to display technologies, and more particularly, to a method, an equipment, and a system of electrical detecting and adjusting TFTs.

BACKGROUND

With a development of display devices, driving circuits for display devices have become an important research hotspot. For a current-driven display device, its luminous brightness depends on the gate-source current flowing through a driving thin film transistor (driving TFT). There is a certain difference in the constant value K of each sub-pixel of the display device, which causes the brightness of the display to be different with the same inputting voltage. The K value is related to parameter characteristics of a TFT. At present, the industry compensates for differences in constant value K through external detection compensation technology. Detection accuracy of constant value K is poor and compensation errors are large.

Therefore, issues of prior art that compensates for differences in constant value K through external detection compensation technology results in poor detection accuracy of constant value K and large compensation errors need to be solved.

SUMMARY

In view of the above, the present disclosure provides a method, an equipment, and a system of electrical detecting and adjusting TFTs to solve the technical issues of prior art that compensates for differences in constant value K through external detection compensation technology results in poor detection accuracy of constant value K and large compensation errors.

In order to achieve above-mentioned object of the present disclosure, one embodiment of the disclosure provides a method of electrical detecting and adjusting thin film transistors (TFTs), including steps of:

obtaining a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase;

detecting an output voltage of each of the driving TFTs in a predetermined sampling time to obtain a detecting voltage, and obtaining a constant value K according an input voltage of each of the driving TFTs and the detecting voltage in the predetermined sampling time;

adjusting the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor, wherein the standard sub-pixel is a random choice from all of the sub-pixels, and the compensating sub-pixels are the sub-pixels other than the standard sub-pixel; and adjusting a pixel voltage of each of the compensating sub-pixels according to its compensating factors to obtain an adjusted pixel voltage.

In one embodiment of the method of electrical detecting and adjusting the TFTs of the disclosure, the step of detecting the output voltage of each of the driving TFTs in the predetermined sampling time to obtain the detecting voltage, includes steps of:

sampling the output voltage of each of the driving TFTs base on the predetermined sampling time in sampling phase to obtain the detecting voltage.

In one embodiment of the method of electrical detecting and adjusting the TFTs of the disclosure, the step of obtaining the gate-source voltage ratio of each of the sub-pixels of the display device, includes steps of:

taking one of the sub-pixels of the display device as a pixel unit to obtain the gate-source voltage ratio of each of the sub-pixels.

In one embodiment of the method of electrical detecting and adjusting the TFTs of the disclosure, the step of obtaining the gate-source voltage ratio of each of the sub-pixels of the display device, further includes steps of:

taking a predetermined number of the sub-pixels of the display device as a pixel region to obtain a region gate-source voltage ratio of each of the pixel regions; and obtaining the gate-source voltage ratio of each of the sub-pixels according to the region gate-source voltage ratio, wherein the gate-source voltage ratio of each of the sub-pixels in the same pixel region is the same.

In one embodiment of the method of electrical detecting and adjusting the TFTs of the disclosure, the compensating factor in the step of adjusting the constant value K of each of compensating sub-pixels in sequence according to the gate-source voltage ratio of the standard sub-pixel, the constant value K of the standard sub-pixel, and the gate-source voltage ratio of one of the compensating sub-pixel to obtain the compensating factor is as a following equation:

$$g_{Ai} = \sqrt{\frac{\Delta V_B}{\Delta V_{Ai}}} \times \frac{a_i}{b}$$

where the $g_{Ai}$ is the compensating factor of the i-th compensating sub-pixel, i equals to 1, 2, 3 . . . n (n is integer), $\Delta V_B$ is the detecting voltage of the standard sub-pixel, b is the gate-source voltage ratio of the standard sub-pixel, $\Delta V_{Ai}$ is the detecting voltage of the i-th compensating sub-pixel, i equals to 1, 2, 3 . . . n (n is integer), $a_i$ is the gate-source voltage ratio of the i-th compensating sub-pixel, i equals to 1, 2, 3 . . . n (n is integer).

Furthermore, another embodiment of the disclosure provides an equipment of electrical detecting and adjusting TFTs, including:

a gate-source voltage ratio obtaining unit configured to obtain a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase;

a K value obtaining unit configured to detect an output voltage of each of the driving TFTs in a predetermined sampling time to obtain a detecting voltage, and obtaining a constant value K according an input voltage of each of the driving TFTs and the detecting voltage in the predetermined sampling time;

a K value compensating unit configured to adjust the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor, wherein the standard sub-pixel is a random choice from all of the sub-pixels, and the compensating sub-pixels are the sub-pixels other than the standard sub-pixel; and a voltage compensating unit configured to adjusting a pixel voltage of each of the compensating sub-pixels according to its compensating factors to obtain an adjusted pixel voltage.

Furthermore, another embodiment of the disclosure provides a system of electrical detecting and adjusting TFTs, including a processor configured to connected to a data driver, wherein the processor is configured to perform any one of the abovementioned methods of electrical detecting and adjusting TFTs In one embodiment of the disclosure, the system of electrical detecting and adjusting the TFTs further includes a storage device connected to the processor, wherein the storage device is configured to store the gate-source voltage ratio and the constant value K of each of the sub-pixels.

In comparison with prior art, the method of electrical detecting and adjusting TFTs provide steps of: obtaining the gate-source voltage ratio of each of the sub-pixels of the display device; detecting and obtaining a constant value K of each of the sub-pixels; adjusting the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor; and adjusting a pixel voltage of each of the compensating sub-pixels according to its compensating factors to obtain an adjusted pixel voltage. The disclosure can eliminate an error of the constant value K came from fluctuation of the gate-source voltage ratio of the sub-pixel to enhance precision of detected constant value K, to enhance precision of compensating of electrical detecting of the TFTs and to make an illumination of each pixels of the display device the same.

BRIEF DESCRIPTION OF DRAWINGS

In order to more clearly illustrate the embodiments of the present application or the technical solutions in the prior art, the drawings used in the embodiments will be briefly described below. The drawings in the following description are only partial embodiments of the present application, and those skilled in the art can obtain other drawings according to the drawings without any creative work.

DETAILED DESCRIPTION

The following description of the embodiments is provided by reference to the drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Figure 1:
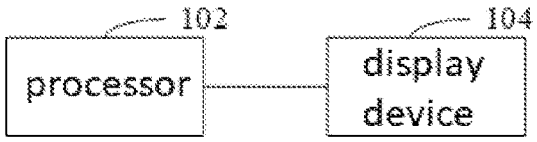
FIG. 1 is a schematic view of an environment of a method of electrical detecting and adjusting thin film transistors (TFTs) according to an embodiment of the present disclosure.

A method of electrical detecting and adjusting thin film transistors (TFTs) provided in this disclosure can be applied to the environment shown in FIG. 1. A processor 102 is connected to a display device 104. The processor 102 may be, but is not limited to, a single-chip microcomputer or an advanced RISC machine (ARM). The display device 104 may be implemented by an independent display device or a display device combination composed of multiple display devices. The display device 104 may be, but is not limited to, an organic light-emitting diode (OLED) display device, a micro light-emitting diode (Micro-LED) display device, or a mini light-emitting diode (Mini-LED) display device.

Figure 2:
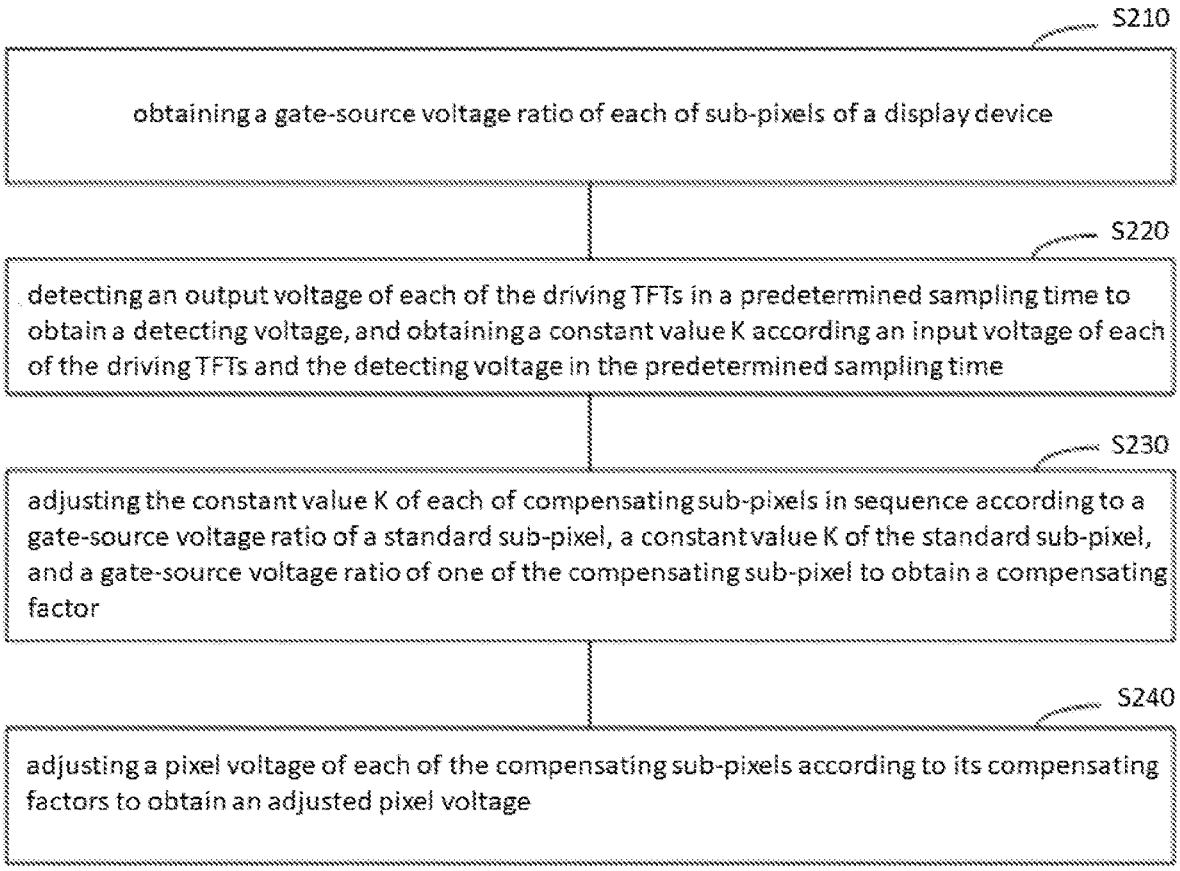
FIG. 2 is a schematic first flowchart of a method of electrical detecting and adjusting TFTs according to an embodiment of the present disclosure.

Referring to FIG. 2, one embodiment of the disclosure provides a method of electrical detecting and adjusting thin film transistors (TFTs). Take the method applying to the processor 102 in FIG. 1 as an example, the method including steps of:

At step S210: obtaining a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase.

In detail, the display device is a current-driven display device. The display device 104 may be, but is not limited to, an OLED display device, a Micro-LED display device, or a Mini-LED display device. The display device includes a plurality of sub-pixels. One of the sub-pixels is corresponding to a light emitting point. The gate-source voltage ratio is a ratio of a gate-source voltage of one of driving TFTs in a sampling phase to a gate-source voltage of one of the driving TFTs in a sensing phase. The driving TFTs is configured to drive corresponding sub-pixels to emit light.

In detail, during the sampling phase, the gate-source voltage of the driving TFT remains constant, and the gate-source voltage ratio rises in a curve during the sensing phase.

Figure 3:
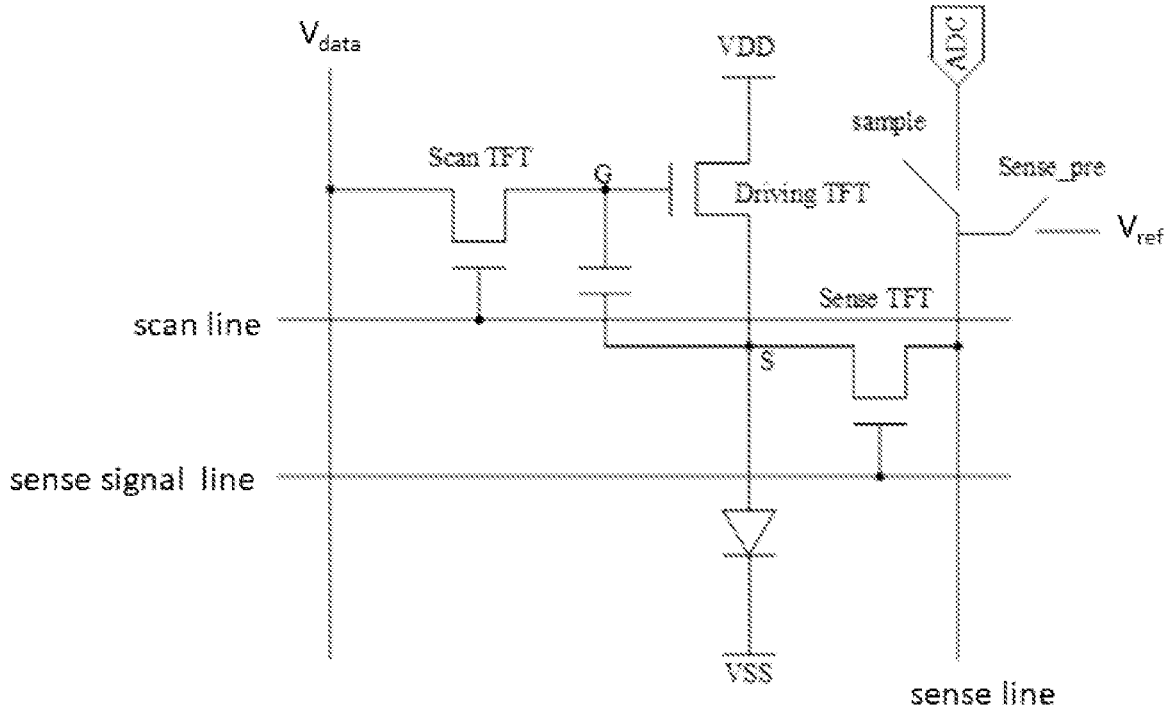
FIG. 3 is a schematic view of a circuit of a 3 transistors-1 capacitor (3T1C) organic light emitting diode (OLED) pixel driving circuit according to another embodiment of the present disclosure.

Referring to FIG. 3, take a 3 TFTs and 1 capacitor (3T1C) OLED pixel driving circuit for example. During the sensing phase Sense_pre, a Scan TFT is conductive, and a Sense TFT is conductive. A gate G of the Driving TFT inputs $V_{data}$, source S inputs $V_{ref}$. The gate-source voltage of the Driving TFT is $V_{gs}=V_{data}-V_{ref}$. During sampling phase Sample, the Scan TFT is turned off, the Sense TFT is conductive, and the Vgs is keeping constant. Under an action of Vgs, a current is flowing from VDD, passing through the Driving TFT and the Sense TFT to charge a lead parasitic capacitance or a capacitor of an ADC. After a predetermined time, a voltage on the sense line can be obtained by the ADC.

At step S220: detecting an output voltage of each of the driving TFTs in a predetermined sampling time to obtain a detecting voltage, and obtaining a constant value K according an input voltage of each of the driving TFTs and the detecting voltage in the predetermined sampling time.

In detail, the output voltage of the driving TFT is an output voltage of a source of the driving TFT. The detecting voltage is a voltage sampling by the analog to digital converter (ADC). The input voltage is a gate input voltage of the driving TFT.

In detail, the constant value K is related to characters of the TFT. In an example, the constant value K of the driving TFT is $$\frac{1}{2}C_i u\frac{W}{L},$$

where Ci is insulating layer capacitance per unit area, u is mobility, W is a channel width of the TFT, and L is a channel length of the TFT.

For example, referring to FIG. 3, during the sampling phase, the Vgs is remaining constant, the current passing through the driving TFT is constant. A current ratio of each sub-pixels can be obtained by a voltage transferred by the ADC, then obtain a ratio of constant value K. when detecting constant value K, the current passing through the driving TFT is $I=K\times V_{data}^2$. The current is charging a parasitic capacitance of the sense line and a capacitor of an ADC (approximately think that the parasitic capacitance of sense line and ADC capacitance of all the sub-pixels are equal, and a combination of those is represented by C). During the sampling phase, a voltage detected by the ADC is $$\Delta V = \frac{t\times I}{C},$$

where t is a time from starting of the sampling phase to a sampling by ADC. Then we obtain $$\Delta V = \frac{t\times K\times V_{data}^2}{C}.$$

Base on the above equation, the input voltage $V_{data}$ of each driving TFT, and detecting voltage ΔV within a sampling time, we can obtain the constant value K.

At step S230: adjusting the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor, wherein the standard sub-pixel is a random choice from all of the sub-pixels, and the compensating sub-pixels are the sub-pixels other than the standard sub-pixel.

In detail, the display device includes a plurality of sub-pixels. The standard sub-pixel is a random choice from all of the sub-pixels, and the compensating sub-pixels are the sub-pixels other than the standard sub-pixel. The standard sub-pixel refers to taking a light-emitting brightness of the sub-pixel as a standard. The compensating sub-pixel refers to a sub-pixel that needs to be compensated and adjusted according to the light-emitting brightness of the standard sub-pixel.

In detail, base on the obtained gate-source voltage ratio of the standard sub-pixel, and the obtained gate-source voltage ratio of the compensating sub-pixel, adjusts the constant value K of each of compensating sub-pixels after obtaining the constant value K of the standard sub-pixel to obtain the compensating factor to eliminate an error of the constant value K came from fluctuation of the gate-source voltage ratio.

At step S240: adjusting a pixel voltage of each of the compensating sub-pixels according to its compensating factors to obtain an adjusted pixel voltage.

In detail, the pixel voltage is a gate input voltage of the driving TFT.

In detail, adjust the pixel voltage of the compensating sub-pixels base on the compensating factor can compensate the error of the constant value K to make an illumination of each sub-pixels of the display device the same.

The method of electrical detecting and adjusting TFTs provide steps of: obtaining the gate-source voltage ratio of each of the sub-pixels of the display device; detecting and obtaining a constant value K of each of the sub-pixels; adjusting the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor; and adjusting a pixel voltage of each of the compensating sub-pixels according to its compensating factors to obtain an adjusted pixel voltage. The disclosure can eliminate an error of the constant value K came from fluctuation of the gate-source voltage ratio of the sub-pixel to enhance precision of detected constant value K, to enhance precision of compensating of electrical detecting of the TFTs and to make an illumination of each pixels of the display device the same.

Referring to FIG. 3, take the display device with the 3T1C OLED pixel driving circuit for example. OLED is a current driving device, and its illumination is base on a current passing through the driving TFT. The driving TFT is working in a saturation region when the OLED is in a light emitting phase. The current is $$I_{ds} = \frac{1}{2}C_i u\frac{W}{L}(V_{gs}-V_{th})^2,$$

where Ci is insulating layer capacitance per unit area, u is mobility, W is a channel width of the TFT, L is a channel length of the TFT, Vgs is gate-source voltage (electrical potential between point G and point S) of the driving TFT, and Vth is a threshold value of the driving TFT. The current can also be expressed as $I_{ds}=K(V_{gs}-V_{th})^2$, where K is the constant value K.

Because there is a certain difference of Vth and K between each sub-pixel, it results in different brightness of the OLED with the same input. It should be noted that, in this application, Vth has been compensated and detected by default.

The following uses two sub-pixels A and B for illustration. A traditional method for detecting the K value is:

After Vth is compensated, a current passing through the driving TFT is $I=K\times V_{data}^2$ when detecting the constant value K. During sampling phase, a voltage detected by ADC is $$\Delta V = \frac{t\times I}{C},$$

where t is the time from starting of the sampling phase to the sampling of ADC. Then the voltage con also be expressed as $$\Delta V = \frac{t\times K\times V_{data}^2}{C}.$$

After the detecting process, we obtain $\Delta V_A$ and $\Delta V_B$ from the sub-pixel A and the sub-pixel B respectively.

Take the $K_B$ of sub-pixel B as a standard, according to a ratio of $\Delta V_A$ and $\Delta V_B$, we can obtain an expression of $K_A$ as $$K_A = \frac{\Delta V_A}{\Delta V_B}\times K_B.$$

Figure 4:
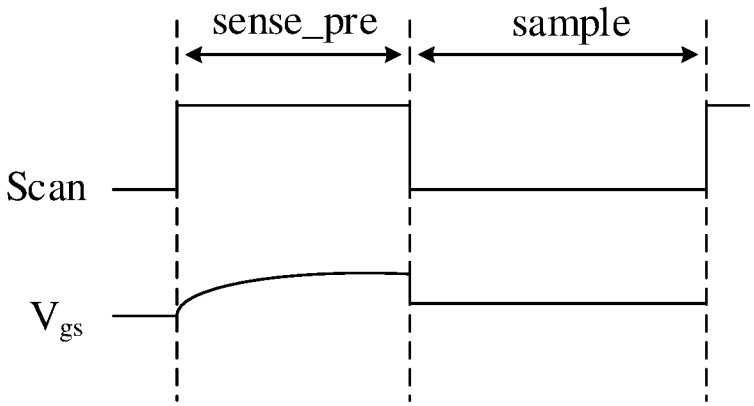
FIG. 4 is a schematic view of a signal waveform of a gate-source voltage of a 3T1C OLED pixel driving circuit according to another embodiment of the present disclosure.

However, a voltage between point G and point S is $V_{gs}$ after writing $V_{data}$ to the sub-pixel during sensing phase. A voltage between point G and point S is $V'_{gs}$ during sampling phase. $V_{gs}$ is not equal to $V'_{gs}$ as shown in FIG. 4. We define $$a = \frac{V'_{gs}}{V_{gs}}.$$

In detail, the word "Scan" in FIG. 4 refers to scan line.

Values of a between different sub-pixels are different. When writing the same $V_{gs}$, values of $V'_{gs}$ of different sub-pixels are different in sampling phase. This cause error in detecting K. There are many reasons for the inequality, mainly in the following three aspects: 1. The capacitive coupling effect of the scan TFT when it is turned off, which causes a level of the G point to decrease; 2. There is leakage at G point, which causes the level of the G point to decrease. Different pixels have different degrees of leakage; 3, the level at point S has changed during the sampling phase, and the level at point G should have the same change due to capacitive coupling. However, because there is other capacitance besides the pixel capacitance C at point G, and each pixel is not exactly the same, the amount of level change at point G is different.

In the traditional method of detecting the K value, the result of the detected K value is inaccurate due to the influence of $\alpha$. During sampling, $I_A=K_A\times(a\times V_{data})^2$ for sub-pixel A, and $I_B=K_B\times(b\times V_{data})^2$ for sub-pixel B. But according to a voltage ratio, for sub-pixel B, $K_B$ actually is $b^2 K_B$, and for sub-pixel A, $K_A$ actually is $$\frac{\Delta V_A}{\Delta V_B}\times\frac{b^2}{a^2}\times K_B,$$

not $$\frac{\Delta V_A}{\Delta V_B}\times K_B.$$

This result in uneven brightness of the display panel after compensating the value K. Therefore, there still exists issues of prior art that compensates for differences in constant value K through external detection compensation technology results in poor detection accuracy of constant value K and large compensation errors.

In the disclosure, the gate-source voltage ratio a is obtained first. We can adjust the value K according to the value a of each sub-pixels after detecting the constant value K to eliminate an error of the constant value K came from fluctuation of the value a to enhance precision of detected constant value K, to enhance precision of compensating of electrical detecting of the TFTs, to make an illumination of each pixels of the display device the same, to enhance precision of compensating of electrical detecting of the TFTs, and to make an illumination of each pixels of the display device the same.

Figure 5:
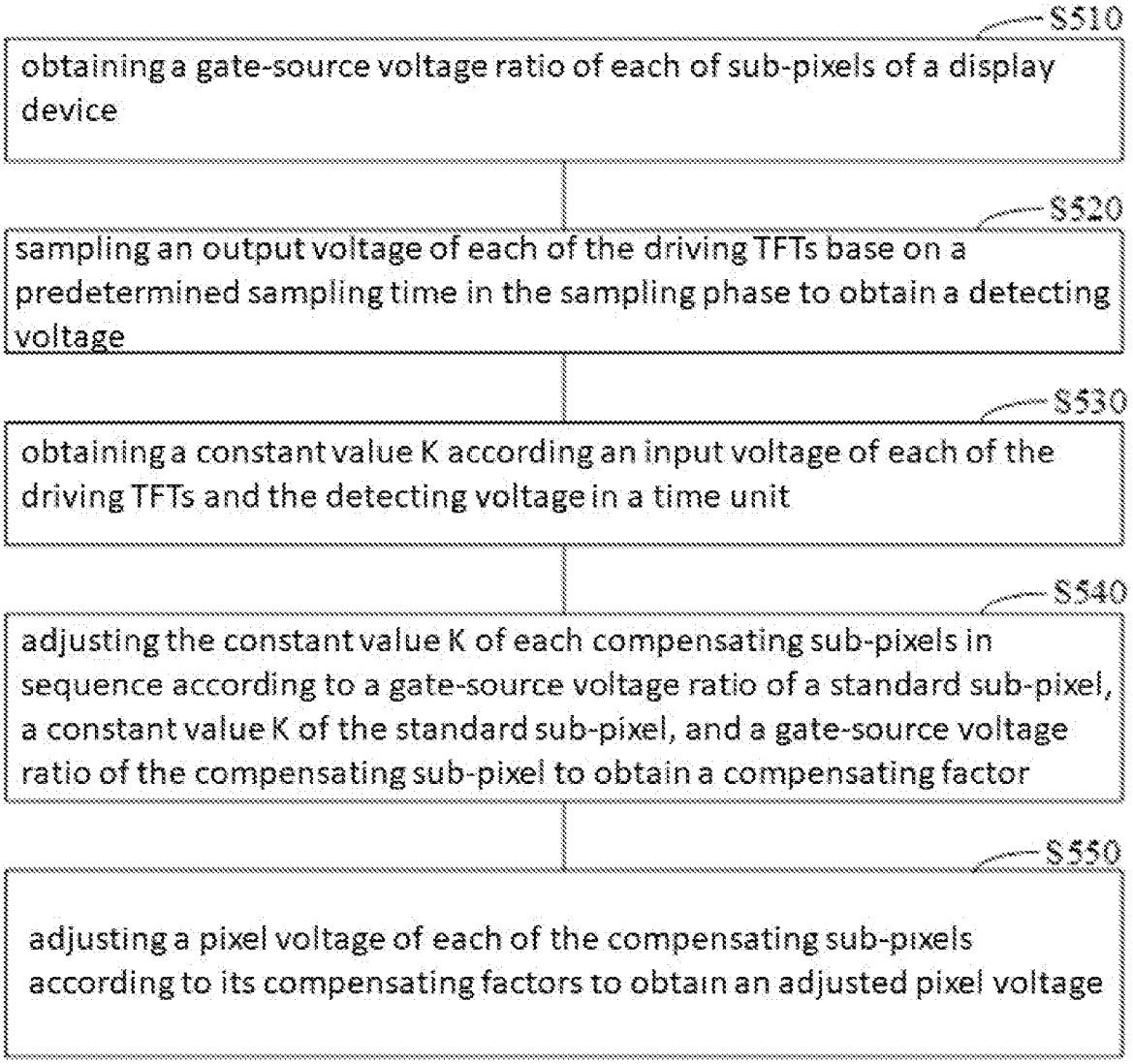
FIG. 5 is a schematic second flowchart of a method of electrical detecting and adjusting TFTs according to an embodiment of the present disclosure.

Referring to FIG. 5, one embodiment of the disclosure provides a method of electrical detecting and adjusting thin film transistors (TFTs). Take the method applying to the processor 102 in FIG. 1 as an example, the method including steps of:

At step S510: obtaining a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase;

At step S520: sampling an output voltage of each of the driving TFTs base on a predetermined sampling time in the sampling phase to obtain a detecting voltage;

At step S530: obtaining a constant value K according an input voltage of each of the driving TFTs and the detecting voltage in the predetermined sampling time;

At step S540: adjusting the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor, wherein the standard sub-pixel is a random choice from all of the sub-pixels, and the compensating sub-pixels are the sub-pixels other than the standard sub-pixel; and At step S550: adjusting a pixel voltage of each of the compensating sub-pixels according to its compensating factors to obtain an adjusted pixel voltage.

For details of the foregoing steps S510, S530, S540, and S550, please refer to the foregoing content, and will not be repeated here.

In detail, obtaining the gate-source voltage ratio of each of the sub-pixels of the display device by obtaining the gate-source voltage of one of the driving TFTs in the sampling phase and the gate-source voltage of one of the driving TFTs in a sensing phase; detecting an output voltage of each of the driving TFTs base on a predetermined sampling time to obtain a detecting voltage; obtaining a constant value K according an input voltage of each of the driving TFTs and the detecting voltage in the predetermined sampling time; adjusting the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor; and adjusting a pixel voltage of each of the compensating sub-pixels according to its compensating factors to obtain an adjusted pixel voltage. The disclosure can eliminate an error of the constant value K came from fluctuation of the gate-source voltage ratio of the sub-pixel to enhance precision of detected constant value K, to enhance precision of compensating of electrical detecting of the TFTs and to make an illumination of each pixels of the display device the same.

In one embodiment of the method of electrical detecting and adjusting the TFTs of the disclosure, the step of obtaining the gate-source voltage ratio of each of the sub-pixels of the display device, includes steps of:

taking one of the sub-pixels of the display device as a pixel unit to obtain the gate-source voltage ratio of each of the sub-pixels.

In detail, take each one of the sub-pixels of the display device as a unit to obtain the gate-source voltage ratio of each of the sub-pixels respectively.

In one embodiment of the method of electrical detecting and adjusting the TFTs of the disclosure, the step of obtaining the gate-source voltage ratio of each of the sub-pixels of the display device, further includes steps of:

taking a predetermined number of the sub-pixels of the display device as a pixel region to obtain a region gate-source voltage ratio of each of the pixel regions; and obtaining the gate-source voltage ratio of each of the sub-pixels according to the region gate-source voltage ratio, wherein the gate-source voltage ratio of each of the sub-pixels in the same pixel region is the same.

In detail, take a predetermined number of the sub-pixels of the display device as a pixel region according to the actual situation of the display device. Divide the display in to predetermined number of the pixel regions. The gate-source voltage ratio of the same color sub-pixels in each pixel region are the same. We only need to obtain the gate-source voltage ratio of any one of the pixel regions in each pixel region, therefore enhance efficiency of data processing.

It should be noted that the gate-source voltage ratio of the sub-pixel can be obtained by system pixel simulation processing, or obtained by actually measuring the gate-to-source voltage of the corresponding sub-pixel in the display device, so that differences in brightness of each region under the conditions that the current gate-source voltages are equal can be obtained, and then establish a corresponding relationship between the compensating sub-pixel and the standard sub-pixel.

In one embodiment of the method of electrical detecting and adjusting the TFTs of the disclosure, the compensating factor in the step of adjusting the constant value K of each of compensating sub-pixels in sequence to obtain the compensating factor is as a following equation:

$$g_{Ai} = \sqrt{\frac{\Delta V_B}{\Delta V_{Ai}}} \times \frac{a_i}{b}$$

where the $g_{Ai}$ is the compensating factor of the i-th compensating sub-pixel, i equals to 1, 2, 3 . . . n (n is integer), $\Delta V_B$ is the detecting voltage of the standard sub-pixel, b is the gate-source voltage ratio of the standard sub-pixel, $\Delta V_{Ai}$ is the detecting voltage of the i-th compensating sub-pixel, i equals to 1, 2, 3 . . . n (n is integer), $a_i$ is the gate-source voltage ratio of the i-th compensating sub-pixel, i equals to 1, 2, 3 . . . n (n is integer).

In detail, obtain the gate-source voltage ratio (b for standard pixel, $a_i$ for compensating pixel) of each of the sub-pixels of the display device first, then adjust the constant value K according to the gate-source voltage ratio of each sub-pixels to obtain the compensating factor to eliminate an error of the constant value K came from fluctuation of the gate-source voltage ratio, and to improve panel uniformity. Compensate the constant value K of corresponding compensating sub-pixel base on the obtaining compensating factor after detecting to enhance precision of detected constant value K.

In detail, adjusting a pixel voltage of the corresponding compensating sub-pixel according to the compensating factor in sequence, such as $V_{data}'=g_A \times V_{data}$ (where $V'_{data}$ is the pixel voltage after adjusting, $V_{data}$ is the pixel voltage before adjusting), when the display device is normally displaying can compensate the error of constant value K and enhance precision of compensating of electrical detecting of the TFTs and to make an illumination of each pixels of the display device the same.

It should be understood that although the steps in the flowcharts of FIG. 2 and FIG. 5 are sequentially displayed according to the directions of the arrows, these steps are not necessarily performed sequentially in the order indicated by the arrows. Unless explicitly stated in the disclosure, the execution of these steps is not strictly limited, and these steps can be performed in other orders. Moreover, at least some of the steps in FIG. 2 and FIG. 5 may include multiple sub-steps or multiple stages. These sub-steps or stages are not necessarily performed at the same time, but may be performed at different times. The execution order of the sub-steps or stages is not necessarily sequential, but can be performed in turn or alternately with other steps or sub-steps of other steps or at least a part of the stages.

Figure 6:
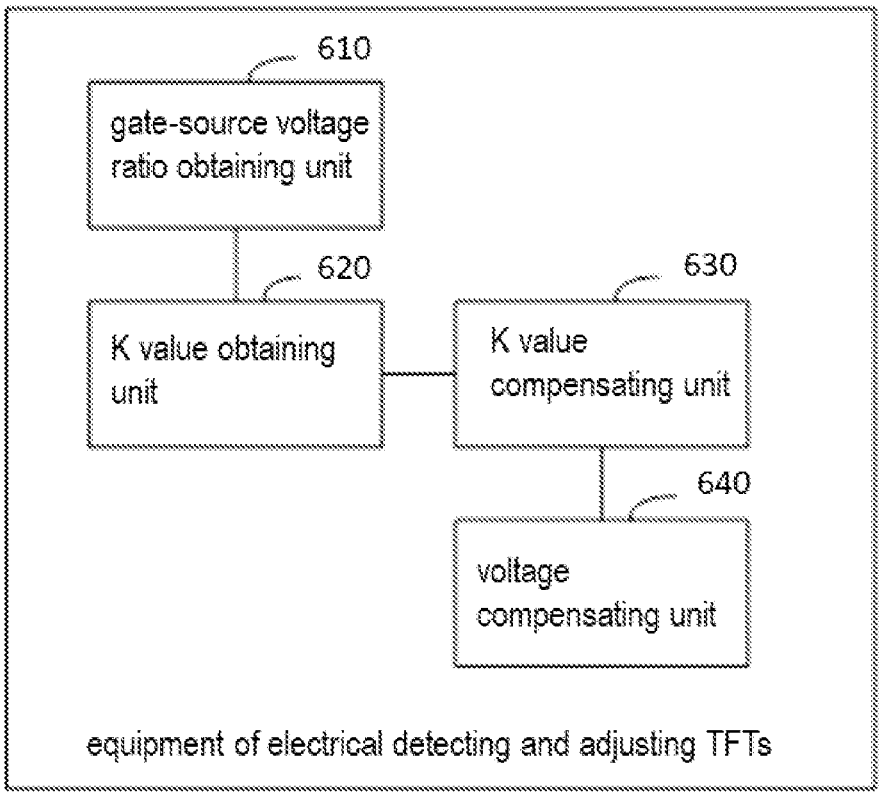
FIG. 6 is a schematic block diagram of an equipment of electrical detecting and adjusting TFTs according to an embodiment of the present disclosure.

Furthermore, referring to FIG. 6, another embodiment of the disclosure provides an equipment of electrical detecting and adjusting TFTs, including:

a gate-source voltage ratio obtaining unit 610 configured to obtain a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase;

a K value obtaining unit 620 configured to detect an output voltage of each of the driving TFTs in a predetermined sampling time to obtain a detecting voltage, and obtaining a constant value K according an input voltage of each of the driving TFTs and the detecting voltage in the predetermined sampling time;

a K value compensating unit 630 configured to adjust the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor, wherein the standard sub-pixel is a random choice from all of the sub-pixels, and the compensating sub-pixels are the sub-pixels other than the standard sub-pixel; and a voltage compensating unit 640 configured to adjusting a pixel voltage of each of the compensating sub-pixels according to its compensating factors to obtain an adjusted pixel voltage.

For the specific limitation of the equipment of electrical detecting and adjusting TFTs, refer to the foregoing limitation on the method of electrical detecting and adjusting TFTs, which will not be repeated here. Each module in the above-mentioned equipment of electrical detecting and adjusting TFTs may be implemented in whole or in part by software, hardware, or a combination thereof. Each of the above modules can be embedded in a processor in hardware or independent of the processor in a system of electrical detecting and adjusting TFTs, or can be stored in the memory of the system of electrical detecting and adjusting TFTs in software to facilitate the processor to call and execute the operations corresponding to the above modules.

Figure 7:
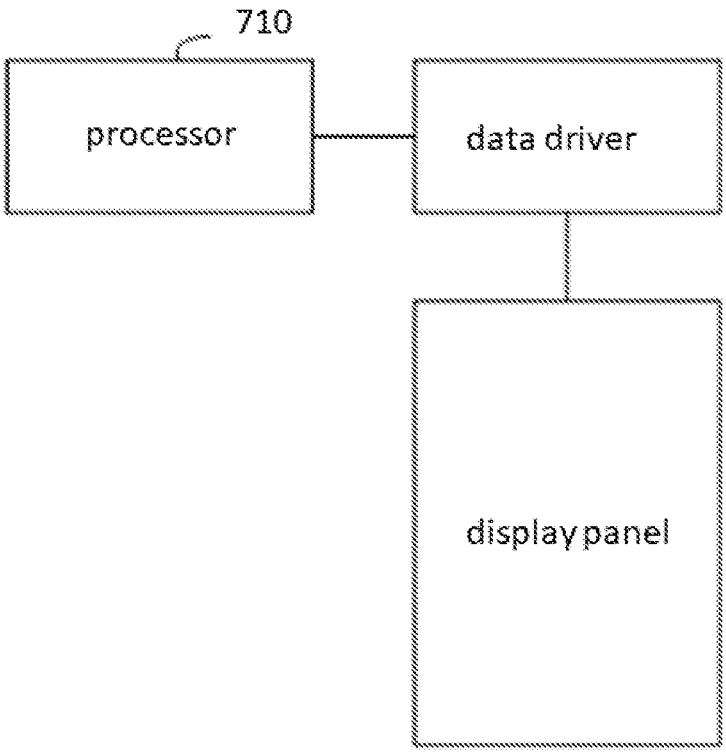
FIG. 7 is a schematic view of a first structure of a system of electrical detecting and adjusting TFTs according to an embodiment of the present disclosure.

Furthermore, referring to FIG. 7, another embodiment of the disclosure provides a system of electrical detecting and adjusting TFTs, including a processor 710 configured to connected to a data driver, wherein the processor 710 is configured to perform any one of the abovementioned methods of electrical detecting and adjusting TFTs The processor 710 is, but is not limited to, a single-chip microcomputer or an ARM. The data driver can be used to convert the adjusted pixel voltage and drive the corresponding sub-pixel according to the converted pixel voltage, so that the corresponding sub-pixel generates brightness.

In detail, the processor 710 is configured to perform the following steps:

obtaining a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase;

detecting an output voltage of each of the driving TFTs in a predetermined sampling time to obtain a detecting voltage, and obtaining a constant value K according an input voltage of each of the driving TFTs and the detecting voltage in the predetermined sampling time;

adjusting the constant value K of each of compensating sub-pixels in sequence according to a gate-source voltage ratio of a standard sub-pixel, a constant value K of the standard sub-pixel, and a gate-source voltage ratio of one of the compensating sub-pixel to obtain a compensating factor, wherein the standard sub-pixel is a random choice from all of the sub-pixels, and the compensating sub-pixels are the sub-pixels other than the standard sub-pixel; and adjusting a pixel voltage of each of the compensating sub-pixels according to its compensating factors to obtain an adjusted pixel voltage.

Figure 8:
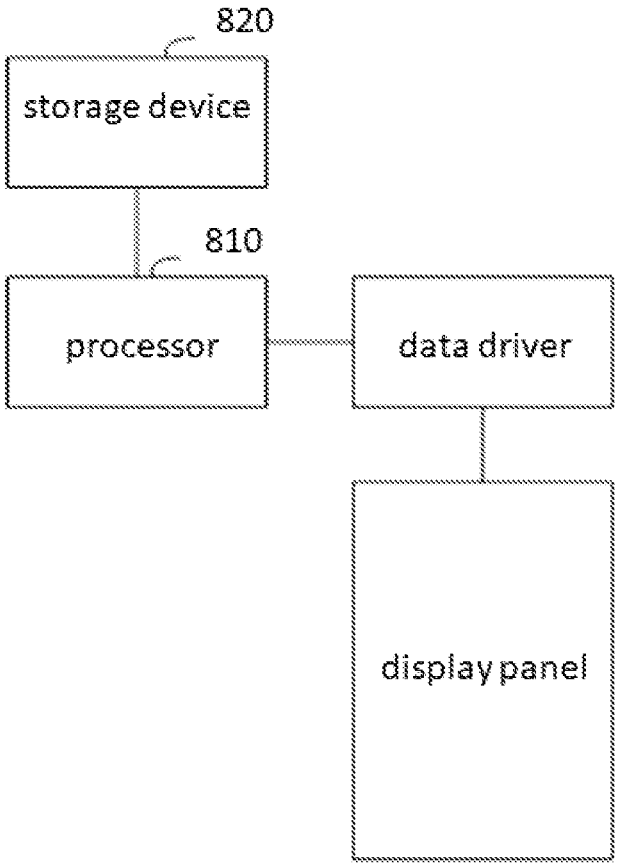
FIG. 8 is a schematic view of a second structure of a system of electrical detecting and adjusting TFTs according to an embodiment of the present disclosure.

Referring to FIG. 8, in one embodiment of the disclosure, the system of electrical detecting and adjusting the TFTs includes a processor 810 configured to connected to a data driver, and a storage device 820 connected to the processor, wherein the storage device 820 is configured to store the gate-source voltage ratio and the constant value K of each of the sub-pixels.

In detail, the storage device 820 may be a non-volatile and/or volatile memory.

In detail, the storage device 820 can store the gate-source voltage ratios of each sub-pixels or pixel regions and store the detected constant value K. The processor 810 can access the gate-source voltage ratios and the constant value K in the storage device when compensating the value K. Compensate the pixel voltage of the corresponding sub-pixel according to the constant value K when the display device is normally displaying to obtain the compensated pixel voltage. Convert the compensated pixel voltage by the date driver. Drive the corresponding sub-pixel according to the converted pixel voltage to illuminate each sub-pixel with the same brightness to enhance precision of detected constant value K and enhance an effect of external compensation.

Figure 9:
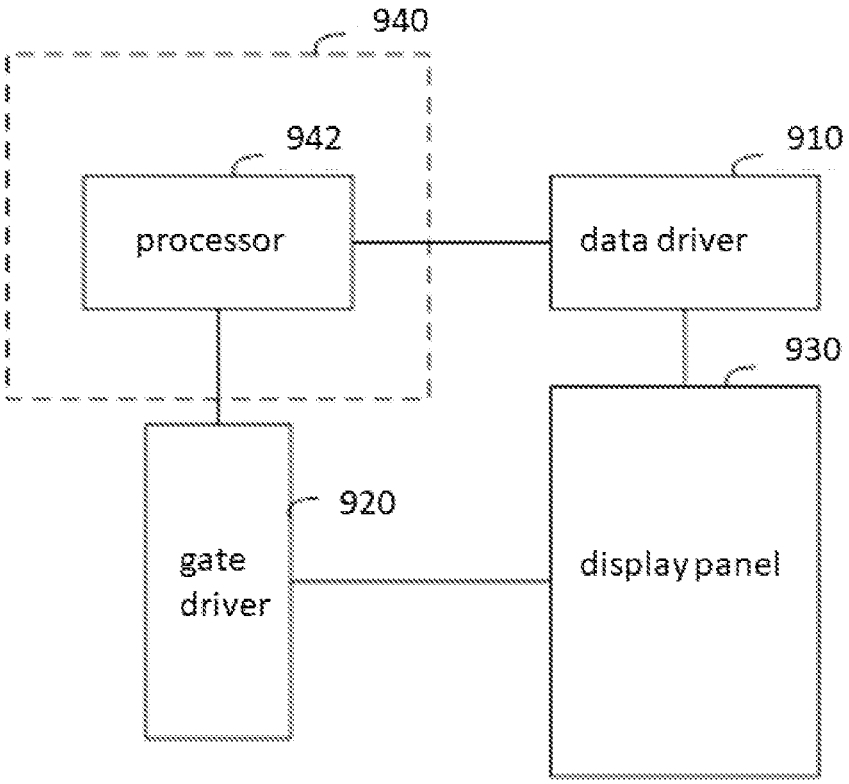
FIG. 9 is a schematic view of a structure of a display device according to an embodiment of the present disclosure.

Referring to FIG. 9, another embodiment of the disclosure provides a display device including a data driver 910, a gate driver 920, a display panel 930, and an above-mentioned system of electrical detecting and adjusting the TFTs 940.

The gate driver 920 is connected to the display panel 930, the display panel 930 is connected to the data driver 910, and a processor 942 is connected to gate driver 920 and data driver 910 respectively.

The gate driver 920 is configured to drive a gate of the driving TFT. The data driver 910 is configured to convert the pixel voltage and drive the corresponding sub-pixel. The display panel 930 includes a plurality of current-driven sub-pixels. In an embodiment, the display panel 930 is a current-driven display panel. For example, the display panel 930 may be, but is not limited to, an OLED display panel, a Micro-LED display panel, or a Mini-LED display panel.

In detail, the processor 942 adjusts the constant value K of each of compensating sub-pixels in sequence according to an obtained gate-source voltage ratio of each sub-pixels of the display device, a detected constant value K of the each sub-pixels, a gate-source voltage of a standard sub-pixel, a constant value K of the standard sub-pixel, and a gate-source voltage ratio of one of the compensating sub-pixel to obtain a compensating factor; and adjusting a pixel voltage of each of the compensating sub-pixels according to its compensating factors in sequence to obtain an adjusted pixel voltage. The processor 942 transmits the adjusted pixel voltage to the data driver 910. The data driver 910 convers the received pixel voltage to drive the corresponding sub-pixel. The processor 942 can further control the gate driver 920 to drive the gate of the corresponding TFT to illuminate each sub-pixel with the same brightness, to eliminate an error of the constant value K came from fluctuation of the gate-source voltage ratio of the sub-pixel, to enhance precision of detected constant value K, and to enhance precision of compensating of electrical detecting of the TFTs.

Those of ordinary skill in the art can understand that the implementation of all or part of the processes in the methods of the above embodiments can be achieved by a computer program to instruct related hardware. The computer program can be stored in a non-volatile computer readable storage medium, when the computer program is executed, it may include the processes of the embodiments of the division operation methods described above. Any reference to the storage, storing, database, or other media used in the embodiments provided in this disclosure may include non-volatile memory and/or volatile memory. Non-volatile memory may include read-only memory (ROM), programmable ROM (PROM), electrically programmable ROM (EPROM), electrically erasable programmable ROM (EEPROM), or flash memory. Volatile memory can include random access memory (RAM) or external cache memory. By way of illustration and not limitation, RAM is available in various forms, such as static RAM (SRAM), dynamic RAM (DRAM), synchronous DRAM (SDRAM), dual data rate SDRAM (DDRSDRAM), enhanced SDRAM (ESDRAM), synch-link DRAM (SLDRAM), rambus direct RAM (RDRAM), direct rambus dynamic RAM (DRDRAM), and rambus dynamic RAM (RDRAM), etc.

The technical features of the embodiments described above can be arbitrarily combined. In order to simplify the description, not all possible combinations of the technical features in the above embodiments have been described. However, as long as there is no contradiction in the combination of these technical features, it should be considered as the scope described in this specification.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A system of electrical detecting and adjusting thin film transistors (TFTs), comprising a processor configured to connected to a data driver, wherein the processor is configured to perform a method of electrical detecting and adjusting TFTs, and the method of electrical detecting and adjusting the TFTs comprises:

obtaining a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase;

detecting an output voltage of each of the driving TFTs in a predetermined sampling time to obtain a detecting voltage, and obtaining an equation of a constant value K according an input voltage of each of the driving TFTs and the detecting voltage in the predetermined sampling time;

adjusting the constant value K in the equation of the constant value K of each of compensating sub-pixels in sequence by a compensating factor obtained by a gate-source voltage ratio of a standard sub-pixel, and a gate-source voltage ratio of one of the compensating-sub-pixels, wherein the standard sub-pixel is a random choice from all of the sub-pixels, and the compensating sub-pixels are the sub-pixels other than the standard sub-pixel; and adjusting a pixel voltage of each of the compensating sub-pixels according to its compensating factors to obtain an adjusted pixel voltage.

2. The system of electrical detecting and adjusting the TFTs according to claim 1, wherein the step of detecting the output voltage of each of the driving TFTs in the predetermined sampling time to obtain the detecting voltage, comprises steps of:

sampling the output voltage of each of the driving TFTs base on the predetermined sampling time in sampling phase to obtain the detecting voltage.

3. The system of electrical detecting and adjusting the TFTs according to claim 1, wherein the step of obtaining the gate-source voltage ratio of each of the sub-pixels of the display device, comprises steps of:

taking one of the sub-pixels of the display device as a pixel unit to obtain the gate-source voltage ratio of each of the sub-pixels.

4. The system of electrical detecting and adjusting the TFTs according to claim 1, wherein the step of obtaining the gate-source voltage ratio of each of the sub-pixels of the display device, further comprises steps of:

taking a predetermined number of the sub-pixels of the display device as a pixel region to obtain a region gate-source voltage ratio of each of the pixel regions; and obtaining the gate-source voltage ratio of each of the sub-pixels according to the region gate-source voltage ratio, wherein the gate-source voltage ratio of each of the sub-pixels in the same pixel region is the same.

5. The system of electrical detecting and adjusting the TFTs according to claim 1, wherein the compensating factor in the step of adjusting the constant value K in the equation of the constant value K of each of compensating-sub-pixels in sequence by a compensating factor obtained by the gate-source voltage ratio of the standard sub-pixel, and the gate-source voltage ratio of one of the compensating-sub-pixels is as a following equation:

$$g_{Ai} = \sqrt{\frac{\Delta V_B}{\Delta V_{Ai}}} \times \frac{a_i}{b}$$

where the gAi is the compensating factor of the i-th compensating sub-pixel, i equals to 1, 2, 3 . . . n (n is integer), $\Delta V_B$ is the detecting voltage of the standard sub-pixel, b is the gate-source voltage ratio of the standard sub-pixel, $\Delta V_{Ai}$ is the detecting voltage of the i-th compensating sub-pixel, i equals to 1, 2, 3 . . . n (n is integer), ai is the gate-source voltage ratio of the i-th compensating sub-pixel, i equals to 1, 2, 3 . . . n (n is integer).

6. The system of electrical detecting and adjusting the TFTs according to claim 1, further comprising a storage device connected to the processor, wherein the storage device is configured to store the gate-source voltage ratio and the equation of the constant value K of each of the sub-pixels.

7. A method of electrical detecting and adjusting thin film transistors (TFTs), comprising steps of:

obtaining a gate-source voltage ratio of each of sub-pixels of a display device, wherein the gate-source voltage ratio is a ratio of a gate-source voltage of one of driving TFTs in a sampling phase to a gate-source voltage of one of the driving TFTs in a sensing phase;

detecting an output voltage of each of the driving TFTs in a predetermined sampling time to obtain a detecting voltage, and obtaining an equation of a constant value K according an input voltage of each of the driving TFTs and the detecting voltage in the predetermined sampling time;

adjusting the constant value K in the equation of the constant value K of each of compensating sub-pixels in sequence by a compensating factor obtained by a gate-source voltage ratio of a standard sub-pixel, and a gate-source voltage ratio of one of the compensating-sub-pixels, wherein the standard sub-pixel is a random choice from all of the sub-pixels, and the compensating sub-pixels are the sub-pixels other than the standard sub-pixel; and adjusting a pixel voltage of each of the according to its compensating factors to obtain an adjusted pixel voltage.

8. The method of electrical detecting and adjusting the TFTs according to claim 7, wherein the step of detecting the output voltage of each of the driving TFTs in the predetermined sampling time to obtain the detecting voltage, comprises steps of:

sampling the output voltage of each of the driving TFTs base on the predetermined sampling time in sampling phase to obtain the detecting voltage.

9. The method of electrical detecting and adjusting the TFTs according to claim 7, wherein the step of obtaining the gate-source voltage ratio of each of the sub-pixels of the display device, comprises steps of:

taking one of the sub-pixels of the display device as a pixel unit to obtain the gate-source voltage ratio of each of the sub-pixels.

10. The method of electrical detecting and adjusting the TFTs according to claim 7, wherein the step of obtaining the gate-source voltage ratio of each of the sub-pixels of the display device, further comprises steps of:

taking a predetermined number of the sub-pixels of the display device as a pixel region to obtain a region gate-source voltage ratio of each of the pixel regions; and obtaining the gate-source voltage ratio of each of the sub-pixels according to the region gate-source voltage ratio, wherein the gate-source voltage ratio of each of the sub-pixels in the same pixel region is the same.

11. The method of electrical detecting and adjusting the TFTs according to claim 7, wherein the compensating factor in the step of adjusting the constant value K in the equation of the constant value K of each of compensating-sub-pixels in sequence by a compensating factor obtained by the gate-source voltage ratio of the standard sub-pixel, and the gate-source voltage ratio of one of the compensating-sub-pixel is as a following equation:

$$g_{Ai} = \sqrt{\frac{\Delta V_B}{\Delta V_{Ai}}} \times \frac{a_i}{b}$$

where the gAi is the compensating factor of the i-th compensating sub-pixel, i equals to 1, 2, 3 . . . n (n is integer), $\Delta V_B$ is the detecting voltage of the standard sub-pixel, b is the gate-source voltage ratio of the standard sub-pixel, $\Delta V_{Ai}$ is the detecting voltage of the i-th compensating sub-pixel, i equals to 1, 2, 3 . . . n (n is integer), ai is the gate-source voltage ratio of the i-th compensating sub-pixel, i equals to 1, 2, 3 . . . n (n is integer).

* * * * *